US011066728B2

(12) United States Patent
Ishida et al.

(10) Patent No.: US 11,066,728 B2
(45) Date of Patent: Jul. 20, 2021

(54) NI-BASED HEAT-RESISTANT ALLOY

(71) Applicants: TOHOKU TECHNO ARCH CO., LTD., Sendai (JP); TANAKA KIKINZOKU KOGYO K.K., Tokyo (JP)

(72) Inventors: Kiyohito Ishida, Sendai (JP); Toshihiro Omori, Sendai (JP); Yutaka Sato, Sendai (JP); Koichi Sakairi, Hiratsuka (JP); Kunihiro Tanaka, Hiratsuka (JP); Tatsuya Nakazawa, Hiratsuka (JP)

(73) Assignees: TOHOKU TECHNO ARCH CO., LTD., Sendai (JP); TANAKA KIKINZOKU KOGYO K.K., Tokyo (JP)

( * ) Notice: Subject to any disclaimer, the term of this patent is extended or adjusted under 35 U.S.C. 154(b) by 33 days.

(21) Appl. No.: 16/471,141

(22) PCT Filed: Dec. 5, 2017

(86) PCT No.: PCT/JP2017/043578
§ 371 (c)(1),
(2) Date: Jun. 19, 2019

(87) PCT Pub. No.: WO2018/116810
PCT Pub. Date: Jun. 28, 2018

(65) Prior Publication Data

US 2019/0316229 A1 Oct. 17, 2019

(30) Foreign Application Priority Data

Dec. 22, 2016 (JP) ..... JP2016-249073

(51) Int. Cl.
*C22C 19/05* (2006.01)
*C22C 30/00* (2006.01)
*C22F 1/10* (2006.01)

(52) U.S. Cl.
CPC ..... *C22C 19/051* (2013.01); *C22C 30/00* (2013.01); *C22F 1/10* (2013.01)

(58) Field of Classification Search
CPC ..... C22C 30/00; C22C 19/03; C22C 19/051; C22C 19/055; C22C 19/056; C22C 19/057; C22F 1/10
See application file for complete search history.

(56) References Cited

U.S. PATENT DOCUMENTS

| | | | |
|---|---|---|---|
| 2004/0229075 A1 | 11/2004 | Gleeson et al. | |
| 2014/0345758 A1 | 11/2014 | Ishida et al. | |
| 2016/0040276 A1 | 2/2016 | Ishida et al. | |
| 2017/0130310 A1 | 5/2017 | Ishida et al. | |

FOREIGN PATENT DOCUMENTS

| | | | | |
|---|---|---|---|---|
| EP | 2 975 145 A | | 1/2016 | |
| GB | 2 105 748 | * | 3/1983 | ..... C22C 19/056 |
| JP | 2007-503530 A | | 2/2007 | |
| JP | 2008-248322 A | | 10/2008 | |
| JP | 2013-095990 A | | 5/2013 | |
| JP | 5721189 B2 | | 5/2015 | |
| WO | WO-2014/142089 A1 | | 9/2014 | |
| WO | WO-2015/146931 A | | 10/2015 | |
| WO | WO-2015/146931 A1 | | 10/2015 | |

OTHER PUBLICATIONS

Tolpygo, V. K., K. S. Murphy, and D. R. Clarke. "Effect of Hf, Y and C in the underlying superalloy on the rumpling of diffusion aluminide coatings." Acta Materialia 56.3 (2008): 489-499.*
Floreen, S., and J. M. Davidson. "The effects of B and Zr on the creep and fatigue crack growth behavior of a Ni-base superalloy." Metallurgical Transactions A 14.4 (1983): 895-901.*
International Searching Authority, "International Search Report," issued in connection with International Patent Application No. PCT/JP2017/043578, dated Mar. 6, 2018.
International Searching Authority, "Written Opinion," issued in connection with International Patent Application No. PCT/JP2017/043578, dated Mar. 6, 2018.
Extended European Search Report dated Nov. 27, 2019 for corresponding Application No. 17884924.6.

* cited by examiner

*Primary Examiner* — Jessee R Roe
(74) *Attorney, Agent, or Firm* — Foley & Lardner LLP

(57) ABSTRACT

The present invention relates to a Ni-based heat-resistant alloy including Ir: 5.0 mass % or more and 50.0 mass % or less, Al: 1.0 mass % or more and 8.0 mass % or less, W: 5.0 mass % or more and 25.0 mass % or less, and balance Ni, having an $L1_2$-structured γ' phase present in the matrix, and including at least one of Zr: 0.01 mass % or more and 3.0 mass % or less and Hf: 0.01 mass % or more and 3.0 mass % or less. This Ni-based heat-resistant alloy has improved toughness over a conventional Ni-based heat-resistant alloy based on a Ni—Ir—Al—W-based alloy, and is also excellent in ambient-temperature strength.

10 Claims, No Drawings

NI-BASED HEAT-RESISTANT ALLOY

RELATED APPLICATIONS

The present application claims priority under 37 U.S.C. § 371 to International Patent Application No. PCT/JP2017/043578, filed Dec. 5, 2017, which claims priority to and the benefit of Japanese Patent Application No. 2016-249073, filed on Dec. 22, 2016. The contents of these applications are hereby incorporated by reference in their entireties.

TECHNICAL FIELD

The present invention relates to a Ni-based heat-resistant alloy with Ir addition. Specifically, it relates to an improved Ni-based heat-resistant alloy having enhanced toughness and ambient-temperature strength over the conventional art, which has been a preferred heat-resistant alloy as a constituent member of high-temperature engines such as jet engines and gas turbines or as a constituent material of tools for friction stir welding.

BACKGROUND ART

In recent years, improvement in heat efficiency for the enhancement of fuel efficiency and the reduction of environmental impact has been required for various heat engines, and there is an increasing demand for enhanced heat resistance in their constituent materials. In addition, as a novel joining method, such as friction stir welding (FSW), has been put into practical use, an alloy having excellent heat resistance to serve as a tool therefor has also been developed. As so-called heat-resistant alloys, Ni-based alloys, Co-based alloys, and the like are conventionally known. However, against the above background, the development of a novel heat-resistant material that can replace them has been studied, and a large number of research reports have been released.

Here, as a heat-resistant alloy that can be alternative to the conventional Ni-based alloys and the like, the applicants of the present application have developed a Ni-based heat-resistant alloy based on a Ni—Ir—Al—W alloy (Patent Document 1). This Ni-based heat-resistant alloy is an alloy obtained by adding Ir, Al, and W as indispensable addition elements to Ni, and has the following composition: Ir: 5.0 to 50.0 mass %, Al: 1.0 to 8.0 mass %, W: 5.0 to 25.0 mass %, and balance Ni.

This Ir-added Ni-based alloy disclosed by the applicants of the present application utilize, as its strengthening mechanism, the precipitation strengthening action of the γ' phase ($(Ni,Ir)_3(Al,W)$), which is an $L1_2$-structured intermetallic compound. The γ' phase shows an inverse temperature dependence, that is, the strength increases with an increase in the temperature, Therefore, excellent high-temperature strength and high-temperature creep properties can be imparted to the alloy.

Related Art Document

Patent Documents

Patent Document 1: Japanese Patent No. 5,721,189

SUMMARY OF THE INVENTION

Problems to be Solved by the Invention

It has been confirmed that the Ni-based heat-resistant alloy disclosed by the applicants of the present application exhibits excellent strength and wear resistance at high temperatures. Then, the possibility of specific application to tools for FSW and the like has also been examined, and excellent results have been basically obtained. However, meanwhile, there also are some improvement requirements.

As a point to be improved, first, improvement in toughness is mentioned. The γ' phase, which is a strengthening factor of the Ni-based heat-resistant alloy, is an intermetallic compound that has high hardness but is poor in ductility. It cannot be denied that the Ni-based heat-resistant alloy abundantly having such a γ' phase is poor in toughness. Therefore, in the case of an FSW tool or the like, breakage (snapping) may occur during use. However, even if the γ' phase affects the toughness of the alloy, in order to ensure high-temperature strength, it is undesirable to reduce the amount of the γ' phase. The difficulty of this problem is that while the state of the γ' phase has to be as conventional, the toughness has to be improved from a different direction.

In addition, as another improvement requirement, enhancement in strength at ambient temperature (room temperature) can be mentioned. The Ni-based heat-resistant alloy is a material developed assuming use at high temperatures, and high-temperature strength is required in the first place. However, depending on its application, high strength may be required from the stage of ambient temperature.

As an example of the heat-resistant alloy application where strength at ambient temperature is also considered, a tool for friction stir welding (FSW) can be mentioned. FSW is a method in which a tool is pressed between materials to be joined, and the tool is moved while being rotated at a high speed, whereby joining is performed using the frictional heat generated between the tool and the materials to be joined and also the action of solid phase stirring. A tool for FSW is subjected to a considerably high temperature at the time of joining, and thus heat resistance is indispensable. However, because the tool is in contact with members to be joined under a high pressure from the stage of ambient temperature at the start of joining (immediately after the start-up of the tool), the ambient-temperature strength should also be considered. For example, in the case of joining relatively soft metals, such as aluminum, the importance of ambient-temperature strength is not so high. However, for hard metals such as ferrous materials (e.g., high-tensile materials), ambient-temperature strength is also important. The Ni-based heat-resistant alloy disclosed by the applicants of the present application is sufficient in terms of high-temperature strength. However, for such applications, it is desirable to improve the ambient-temperature strength even if it causes some decrease in the high-temperature strength.

Thus, the present invention provides an alloy material having improved toughness over the conventional Ni-based heat-resistant alloy disclosed by the applicants of the present application and also having excellent ambient-temperature strength.

Means for Solving the Problems

The present inventors have examined the mode of material break that occurs in the Ni-based heat-resistant alloy disclosed by the applicants of the present application described above. As a result, they have come to the idea that the break tends to occur near the grain boundary of the matrix of the alloy. In the Ni-based heat-resistant alloy disclosed by the applicants of the present application, the γ phase, which is its matrix, contains Ir relatively abundantly, but the alloy is still an "Ni-based alloy" and originally does not lack toughness. However, near the grain boundary, presumably, due to the influence of the trace amount of oxygen (oxide) segregated during the alloy casting process, the strength slightly decreases. Meanwhile, within the matrix grains, because the γ' phase, which is the strengthening factor of the alloy, tends to precipitate within grains, the strength within grains increases. Then, because of these factors, there is a difference in strength between within grains and at grain boundaries in the matrix of the alloy, presumably causing a break near the grain boundary.

Based on the above considerations, the present inventors have decided to enhance the grain boundary strength of the matrix as the direction of toughness improvement of the conventional Ni-based heat-resistant alloy disclosed by the applicants of the present application. Then, as a result of extensive research, they have found that the addition of predetermined concentrations of Zr (zirconium) and Hf (hafnium) to the Ni-based heat-resistant alloy has the effect of improving the toughness of the alloy and also has the effect of enhancing the strength at ambient temperature, and thus arrived at the present invention.

That is, the present invention is a Ni-based heat-resistant alloy including Ir: 5.0 mass % or more and 50.0 mass % or less, Al: 1.0 mass % or more and 8.0 mass % or less, W: 5.0 mass % or more and 25.0 mass % or less, and balance Ni and having an $L1_2$-structured γ' phase present in the matrix. The Ni-based heat-resistant alloy includes at least one of Zr: 0.01 mass % or more and 3.0 mass % or less and Hf: 0.01 mass % or more and 3.0 mass % or less.

As described above, the heat-resistant alloy of the present invention is based on a Ni-based alloy having Ir as well as Al and W as addition elements. In this Ir-added Ni-based alloy, because the amount of each addition element, such as Ir, added is within the above range, the γ' phase, which can function as a strengthening phase in a high-temperature environment, is precipitated. Then, Zr and Hf are added thereto to achieve improvement, for example, in toughness. Hereinafter, with respect to the present invention, each addition element and the structure of the γ' phase will be described in detail.

Ir, which is an indispensable addition element, is an addition element that is dissolved in the matrix (γ phase) and partially substitutes Ni of the γ' phase, thereby increasing the solidus temperature and the dissolution temperature of the γ phase and the γ' phase, respectively, to enhance the heat resistance. A Ni alloy having a γ' phase as a strengthening phase itself is known. However, the addition of Ir strengthens both the γ phase and the γ' phase and allows for the exhibition of high-temperature properties over conventional Ni-based alloys. Therefore, Ir is an extremely important addition element. This Ir exhibits the above effect when the amount of addition is 5.0 mass % or more. However, in the case of excessive addition, the solidus temperature of the alloy becomes too high, and also the specific gravity of the alloy becomes too high. Therefore, the upper limit is specified to be 50.0 mass %. The amount of Ir is preferably 20 mass % or more and 35 mass % or less.

Al is a constituent element of the γ' phase, and thus is a component necessary for the precipitation of the γ' phase. When the amount of Al is less than 1.0 mass %, no γ' phase is precipitated, or, even if precipitated, such a γ' phase is not in the state of capable of contributing to the enhancement in high-temperature strength. Meanwhile, with an increase in Al concentration, the proportion of the γ' phase increases. However, when Al is excessively added, the proportion of a B2-type intermetallic compound (NiAl; hereinafter sometimes referred to as B2 phase) increases, resulting in embrittlement and a decrease in the strength of the alloy. For this reason, the upper limit of the Al amount is specified to as 8.0 mass %. Incidentally, Al also contributes to enhancement in the oxidation resistance of the alloy. The amount of Al is preferably 1.9 mass % or more and 6.1 mass % or less.

W is an addition element that increases the dissolution temperature of the γ' phase to ensure the stability at high temperatures. When the amount of W added is less than 5.0 mass %, the effect of enhancing the high-temperature stability of the γ' phase is not sufficient. Meanwhile, when the amount is more than 25.0 mass %, a phase containing W as a main component and having a high specific gravity tends to be generated, and segregation is likely to occur. The amount of W is preferably 10.0 mass % or more and 20.0 mass % or less.

In the present invention, in addition to the above addition elements, Zr and/or Hf is further indispensably added. These addition elements are addition elements for suppressing the segregation of oxides at the grain boundary of the matrix. When Zr and/or Hf is added, during the alloy casting process, a trace amount of oxygen in the molten metal binds with these addition elements, whereby oxide segregation at the grain boundary is suppressed. As a result, the difference in strength between within grains and at grain boundaries is reduced, and the toughness at high temperatures is improved. In addition, Zr and Hf can be evaluated not only for having the above action when added in proper amounts, but also for being unlikely to change the state of the γ' phase, which is a characteristic of the Ir-added Ni-based alloy.

Then, with respect to the amounts of Zr and Hf added, the amount of Zr is specified to be 0.01 mass % or more and 3.0 mass % or less. In addition, the amount of Hf is specified to be 0.01 mass % or more and 3.0 mass % or less. In each case, the addition of less than the lower limit is ineffective, while the addition of more than the upper limit causes a significant decrease in the dissolution temperature of the γ' phase and reduces the high-temperature strength of the alloy. The amount of Zr is preferably 0.8 mass % or more and 2.0 mass % or less, and more preferably 1.2 mass % or more and 2.0 mass % or less. In addition, the amount of Hf is preferably 1.0 mass % or more and 2.0 mass % or less, and more preferably 1.2 mass % or more and 2.0 mass % or less. Zr and Hf exhibit the effect when either of them is added within the above range. In addition, it is also possible that both Zr and Hf are added within the above ranges. When both are added, the total concentration is preferably 1.0 mass % or more and 2.0 mass % or less.

Then, in the present invention, the $L1_2$-structured γ' phase is dispersed as a strengthening factor of the alloy. The structure of the γ' phase is $(Ni,Ir)_3(Al,W)$. The precipitation strengthening action caused by the γ' phase is the same as in the conventional Ir-added Ni-based alloy disclosed by the applicants of the present application. The γ' phase has the inverse temperature dependence about strength and thus also has excellent high-temperature stability.

The γ' phase in the present invention preferably has an average particle size within a range of 0.01 μm or more and 1 μm or less. In addition, the precipitation amount of the γ' phase is preferably 20 vol % or more 85 vol % or less in total based on the whole alloy. The precipitation strengthening action can be obtained with a precipitate of 0.01 μm or more, but rather decreases with a coarse precipitate of 1 μm or more. The average particle size of the γ' phase can be measured by linear analysis, for example. In addition, in order to sufficiently obtain the precipitation strengthening action caused by the γ' phase, a precipitation amount of 20 vol % or more is necessary. However, an excessive precipitation amount of more than 85 vol % is feared to cause a deterioration in ductility. In order to obtain a suitable particle size or precipitation amount, a gradual aging treatment in a predetermined temperature region is preferably performed in the production method described below.

Incidentally, the Ni-based alloy of the present invention does not completely exclude the precipitation of other phases besides the γ' phase. In the case where Al, W, and Ir are added in the above ranges, depending on the composition, not only the γ' phase but also a B2 phase may be precipitated. In addition, an ε' phase having a D019 structure may also be precipitated. In the Ir-added Ni-based alloy of the present invention, even when these precipitates other than the γ' phases are present, the high-temperature strength is ensured. However, in the Ni-based alloy of the present invention, the precipitation of the B2 phase is relatively suppressed.

Then, in the Ni-based heat-resistant alloy of the present invention, in order to improve its high-temperature properties, additional addition elements may be added. Examples of such additional addition elements include Co, Cr, Ta, Nb, Ti, V, Mo, and B.

As the addition action, Co partially substitutes Ni of the γ' phase and becomes a constituent element of the γ' phase. Accordingly, Co is effective in increasing the proportion of the γ' phase to raise the strength. Such an effect can be seen when the amount of Co added is 5.0 mass % or more. However, excessive addition lowers the dissolution temperature of the γ' phase, resulting in the deterioration of high-temperature properties. Therefore, the upper limit of the Co content is preferably 20.0 mass %.

Cr is effective in strengthening the grain boundary of the matrix. In addition, in the case where C is added to the alloy, Cr forms a carbide and precipitates near the grain boundary, thereby strengthening the grain boundary. The effect of the addition of Cr can be seen when the amount added is 1.0 mass % or more.

However, excessive addition decreases the melting point of the alloy and the dissolution temperature of the γ' phase, resulting in the deterioration of high-temperature properties. Therefore, the amount of Cr added is preferably 25.0 mass % or less. Incidentally, Cr also acts to form a dense oxide film on the alloy surface and enhance the oxidation resistance.

Ta is an element that is effective both in stabilizing the γ' phase and in enhancing the high-temperature strength within the matrix grains by solid-solution strengthening. In addition, in the case where C is added to the alloy, Ta can form a carbide and precipitate, and thus is an addition element effective in strengthening grain boundary. Ta exhibits the above action when the amount added is 1.0 mass % or more. In addition, because excessive addition causes the generation of a harmful phase or a decrease in the melting point, the upper limit is preferably 10.0 mass %.

Nb, Ti, V, and Mo are also addition elements effective in stabilizing the γ' phase and in strengthening solid-solution within the matrix grains to improve the high-temperature strength. The amounts of Nb, Ti, V, and Mo added are preferably 1.0 mass % or more and 5.0 mass % or less.

B is an alloy component that segregates at the crystal grain boundary of the matrix to strengthen the grain boundary, and contributes to enhancement in high-temperature strength and toughness. The effect of the addition of B becomes prominent when the amount is 0.001 mass % or more. However, excessive addition is undesirable for processability, and thus the upper limit is specified to be 0.1 mass %. The amount of B added is preferably 0.005 mass % or more and 0.02 mass % or less.

In addition, other than the above elements, C can be mentioned as an addition element effective in enhancing strength. C forms a carbide together with metal elements in the alloy and precipitates, thereby enhancing the high-temperature strength. Such an effect can be seen when the amount of C added is 0.001 mass % or more. However, excessive addition deteriorates processability or toughness, and thus the upper limit of the C content is specified to be 0.5 mass %. The C content is preferably 0.01 mass % or more and 0.2 mass % or less. Incidentally, the C content in the present invention is the total amount of C present in the alloy including the amount of C forming a carbide and the amount of C not forming a carbide.

Ni-based heat-resistant alloys with addition of the further addition elements described above, that is, Co, Cr, Ta, Nb, Ti, V, Mo, B, and C, are not different in the material structure from alloys without such additions. The crystal structure of the γ' phase, which is a strengthening phase, is also the same $L1_2$ structure, and the suitable particle size and precipitation amount thereof are also in the same ranges. However, because Co, Cr, Ta, Nb, Ti, V, and Mo act also as constituent elements of the γ' phase, the γ' phase in the alloy containing them has the structure of $(Ni,X)_3(Al,W,Z)$ (X is Ir or Co, and Z is Ta, Cr, Nb, Ti, V, or Mo). In addition, the precipitation of intermetallic compounds other than the γ' phase is also allowed, and a B2-type intermetallic compound (Ni,X)(Al, W,Z): the meanings of X and Z are the same as above) may be precipitated. Even when precipitation phases other than the γ' phase are present, as long as each constituent element is within the preferred range, and the γ' phase is precipitated, there are no problems with the high-temperature strength.

In the production of the Ni-based heat-resistant alloy of the present invention, a common dissolution/casting method is applicable. Then, the alloy ingot after casting is subjected to an aging heat treatment, whereby the γ' phase can be precipitated. In this aging heat treatment, the alloy ingot is heated to a temperature region of 700 to 1,300° C. The temperature region is preferably 750 to 1,200° C. In addition, the heating time at this time is preferably 30 minutes to 72 hours. Incidentally, this heat treatment may be performed a plurality of times. For example, the alloy ingot may be heated at 1,100° C. for 4 hours and further at 900° C. for 24 hours.

In addition, prior to the aging heat treatment, it is preferable to perform a heat treatment for homogenization. In this homogenizing heat treatment, the alloy ingot is heated to the temperature region of 1,100 to 1,800° C. The alloy ingot is preferably heated at a temperature within a range of 1,200 to 1,600° C. The heating time at this time is preferably 30 minutes to 72 hours.

Advantageous Effects of the Invention

In the present invention, toughness at high temperatures is improved over a conventional Ni-based heat-resistant alloy. In addition, while suppressing a decrease in strength at high temperatures, the strength at ambient temperature is enhanced. Enhancement in toughness or ambient-temperature strength is an effective measure to avoid breakage during use for a member that is subjected to a high load from an ambient temperature region to a high temperature range, such as a tool for FSW.

DESCRIPTION OF EMBODIMENTS

Hereinafter, preferred embodiments of the present invention will be described.

First Embodiment: In this embodiment, with respect to the Ni—Ir—Al—W alloy, which is the basic composition of the Ni-based heat-resistant alloy of the present invention, the effect of the addition of Zr and Hf was examined. Alloys with addition of 2.0 mass % Ru and 3.0 mass % Re were produced. Specifically, a Ni—Ir—Al—W alloy (Ir: 25.0 mass %, Al: 4.38 mass %, W: 14.33 mass %, and balance Ni) and a Ni-based heat-resistant alloy obtained by adding 1.2 mass % of Zr and Hf to this alloy were produced, and their mechanical properties were evaluated. In addition, a Ni-based heat-resistant alloy obtained by adding an addition element such as Co to a Ni—Ir—Al—W alloy was also produced and evaluated.

In the production of a Ni-based heat-resistant alloy, in a melting/casting step, molten metals of various compositions were ingoted by arc melting in an inert gas atmosphere, and cast in a mold and cooled/solidified in air. Each alloy ingot produced in the melting/casting step was subjected to a homogenizing heat treatment under conditions of 1,300° C. for 4 hours, and, after heating for a predetermined period of time, air-cooled. The ingot was then subjected to an aging heat treatment under conditions of a temperature of 800° C. and a retention time of 24 hours, and, after heating for a predetermined period of time, annealed to give an ingot 7 mm in diameter, and a test piece was produced therefrom. The test pieces of various compositions thus obtained were evaluated and examined as follows.

[Measurement of γ' Phase Dissolution Temperature]

Each test piece was subjected to scanning differential calorimetry (DSC) to measure the γ' phase dissolution temperature (solvus temperature). The measurement conditions were such that the measurement temperature range was up to 1,600° C., and the temperature rise rate was 10° C./min. Then, from the endothermic peak position appearing as a result of the decomposition/dissolution of the γ' phase, the γ' phase dissolution temperature was measured.

[Strength Evaluation]

Each test piece was subjected to a Vickers test (load: 500 gf, pressing time: 15 seconds) to measure the hardness. The hardness measurement was performed at ambient temperature (room temperature: 25° C.) and a high temperature (900° C.).

[Toughness Evaluation]

Each test piece was subjected to a hot bending test to evaluate the toughness (ductility) of the alloy. In this test, the test piece was subjected to a bending test in a high-temperature atmosphere of 900° C. under varying loads to prepare a load-displacement diagram, and the amount of displacement at material break was measured.

The compositions of the produced alloys and the various evaluation results in this embodiment are shown in Table 1.

TABLE 1

| | | Alloy composition (mass %) | | | | | | | | | |
|---|---|---|---|---|---|---|---|---|---|---|---|
| | No. | Ni | Ir | Al | W | Co | Cr | Ta | C | B | Zr |
| Example | A1 | Balance | 25.00 | 4.38 | 14.33 | — | — | — | — | — | 1.20 |
| | A2 | | 25.00 | 4.38 | 14.33 | 7.64 | 6.10 | 4.68 | — | — | |
| | A3 | | 25.00 | 4.38 | 14.33 | 7.64 | 6.10 | 4.68 | 0.11 | — | |
| | A4 | | 25.00 | 4.38 | 14.33 | — | — | 4.68 | — | — | |
| | B1 | | 25.00 | 4.38 | 14.33 | — | — | — | — | — | — |
| | B2 | | 25.00 | 4.38 | 14.33 | 7.64 | 6.10 | 4.68 | — | — | |
| | B3 | | 25.00 | 4.38 | 14.33 | 7.64 | 6.10 | 4.68 | 0.11 | — | |
| | B4 | | 25.00 | 4.38 | 14.33 | — | — | 4.68 | — | — | |
| Conventional Example | C1 | | 25.00 | 4.38 | 14.33 | — | — | — | — | — | — |

| | No. | Alloy composition (mass %) Hf | γ' Phase dissolution temperature (° C.) | Hardness (Hv) Ambient temperature | Hardness (Hv) 900° C. | Amount of displacement |
|---|---|---|---|---|---|---|
| Example | A1 | — | 1328 | 358 | 264 | 1.23 |
| | A2 | | 1364 | 377 | 279 | 1.01 |
| | A3 | | 1391 | 396 | 301 | 0.88 |
| | A4 | | 1261 | 418 | 314 | 0.71 |
| | B1 | 1.20 | 1460 | 353 | 176 | 1.18 |
| | B2 | | 1411 | 405 | 221 | 0.83 |
| | B3 | | 1421 | 373 | 276 | 0.78 |
| | B4 | | 1483 | 441 | 334 | 0.55 |
| Conventional Example | C1 | — | | 344 | 228 | 0.25 |

Based on Table 1, the properties of the Ni-based heat-resistant alloys in this embodiment will be examined below. As compared with the conventional example (C1), which is a Ni—Ir—Al—W alloy serving as the basic composition of the Ni-based heat-resistant alloy of the present invention, it can be confirmed that in the alloys produced by adding Zr and Hf to the Ni-based heat-resistant alloy, the amount of displacement in the bending test at 900° C. significantly increased, and the toughness in a high temperature range was significantly improved (No. A1, No. B1). In addition, these alloys have increased hardness at ambient temperature. Therefore, it was confirmed that in a Ni—Ir—Al—W alloy of the basic composition containing no addition elements such as Co, the addition of Zr or Hf can achieve improvement in toughness in a high temperature range and enhancement in ambient-temperature strength.

However, a Ni—Ir—Al—W alloy of the basic composition originally has low hardness. Therefore, the addition of Zr or Hf reduces the hardness at high temperatures. This tendency is particularly seen in the alloy No. B1 with Hf addition. Thus, addition elements (Co, Cr, Ta, C, etc.) are added to raise the level of the strength properties of the alloy, and Zr or Hf is then added; as a result, a Ni-based heat-resistant alloy having further improved strength at high temperatures can be obtained (No. A2 to No. A4, No. B2 to No. B4). Incidentally, it was also confirmed that even when these addition elements are added, the precipitation of the γ' phase can be developed, and also there are no problems with its high-temperature stability (dissolution temperature).

Second Embodiment: Alloys were prepared with reference to the results of the first embodiment. That is, the amount of Zr and Hf added was fixed to 1.2 mass %, while the concentration of Ir of the base Ni-based alloy was changed within a range of 5.0 mass % to 35 mass %. The alloy production process was basically the same as in the first embodiment, and alloy ingots after melting/casting were subjected to a homogenizing treatment and then to an aging heat treatment to cause the precipitation of the γ' phase. However, according to the Ir concentration, the temperature of the aging heat treatment was adjusted to 1,200° C. to 1,400° C., and the temperature of the homogenizing treatment to 700° C. to 900° C. Then, after the processing of test pieces, the same evaluation test as in the first embodiment was performed. The results are shown in Table 2.

TABLE 2

| | | Alloy composition (mass %) | | | | | | | | | |
|---|---|---|---|---|---|---|---|---|---|---|---|
| | No. | Ni | Ir | Al | W | Co | Cr | Ta | C | B | Zr |
| Example | A5 | Balance | 5.00 | 4.77 | 14.13 | 9.06 | 7.19 | 5.56 | 0.14 | 0.01 | 1.20 |
| | A6 | | 10.00 | 4.60 | 13.62 | 8.74 | 6.94 | 5.36 | 0.13 | 0.01 | |
| | A7 | | 25.00 | 4.38 | 14.33 | 7.64 | 6.10 | 4.68 | 0.11 | 0.01 | |
| | A8 | | 35.00 | 3.75 | 11.08 | 7.11 | 5.64 | 4.36 | 0.11 | 0.01 | |
| | B5 | | 5.00 | 4.77 | 14.13 | 9.06 | 7.19 | 5.56 | 0.14 | 0.01 | — |
| | B6 | | 10.00 | 4.60 | 13.62 | 8.74 | 6.94 | 5.36 | 0.13 | 0.01 | |
| | B7 | | 25.00 | 4.38 | 14.33 | 7.64 | 6.10 | 4.68 | 0.11 | 0.01 | |
| | B8 | | 35.00 | 3.75 | 11.08 | 7.11 | 5.64 | 4.36 | 0.11 | 0.01 | |
| Conventional Example | C1 | | 25.00 | 4.38 | 14.33 | — | — | — | — | — | — |

| | No. | Alloy composition (mass %) Hf | γ' Phase dissolution temperature (° C.) | Hardness (Hv) Ambient temperature | Hardness (Hv) 900° C. | Amount of displacement |
|---|---|---|---|---|---|---|
| Example | A5 | — | 1243 | 514 | 285 | 0.50 |
| | A6 | | 1258 | 543 | 340 | 0.51 |
| | A7 | | 1256 | 618 | 395 | 0.49 |
| | A8 | | 1306 | 612 | 413 | 0.48 |
| | B5 | 1.20 | 1243 | 468 | 263 | 0.79 |
| | B6 | | 1248 | 506 | 313 | 0.66 |
| | B7 | | 1252 | 486 | 363 | 0.52 |
| | B8 | | 1338 | 549 | 384 | 0.62 |
| Conventional Example | C1 | — | | 344 | 228 | 0.25 |

From Table 2, it was confirmed that even when the amount of Ir added to Ni-based heat-resistant alloys with addition of Zr and Hf is set in a wide range, the γ' phase is stable, and these alloys have suitable high-temperature strength and toughness.

Third Embodiment: attention was here focused on the Ni—Ir—Al—W alloys No. A7 and No. B7 (the amount of Ir added: 25 mass %), which were excellent in hardness and compressive strength at both ambient temperature and a high temperature, and also had excellent toughness, in the second embodiment. In this embodiment, the amounts of Zr and Hf added were changed in this alloy system to produce Ni-based heat-resistant alloys, and their properties were evaluated. The alloy production process and the evaluation method are basically the same as in the first embodiment. The evaluation results are shown in Table 3.

TABLE 3

| | No. | Alloy composition (mass %) | | | | | | | | | |
|---|---|---|---|---|---|---|---|---|---|---|---|
| | | Ni | Ir | Al | W | Co | Cr | Ta | C | B | Zr |
| Example | A9 | Balance | 25.00 | 4.38 | 14.33 | 7.64 | 6.10 | 4.68 | 0.11 | 0.01 | 2.00 |
| | A10 | | | | | | | | | | 1.50 |
| | A7 | | | | | | | | | | 1.20 |
| | A11 | | | | | | | | | | 0.80 |
| | A12 | | | | | | | | | | 0.01 |
| | B9 | | | | | | | | | | — |
| | B10 | | | | | | | | | | — |
| | B7 | | | | | | | | | | — |
| | B11 | | | | | | | | | | — |
| | B12 | | | | | | | | | | — |
| | AB1 | | | | | | | | | | 0.90 |
| | AB2 | | | | | | | | | | 0.60 |
| | AB3 | | | | | | | | | | 0.30 |
| Comparative Example | X1 | | | | | | | | | | 4.00 |
| | X2 | | | | | | | | | | 0.005 |
| | Y1 | | | | | | | | | | — |
| | Y2 | | | | | | | | | | — |
| Conventional Example | C2 | | | | | | | | | | — |

| | No. | Alloy composition (mass %) Hf | γ' Phase dissolution temperature (° C.) | Hardness (Hv) Ambient temperature | Hardness (Hv) 900° C. | Amount of displacement |
|---|---|---|---|---|---|---|
| Example | A9 | — | 1216 | 673 | 360 | 0.88 |
| | A10 | — | 1208 | 585 | 368 | 0.79 |
| | A7 | — | 1256 | 618 | 395 | 0.66 |
| | A11 | — | 1270 | 610 | 376 | 0.58 |
| | A12 | — | 1251 | 504 | 356 | 0.51 |
| | B9 | 2.00 | 1249 | 588 | 367 | 0.59 |
| | B10 | 1.50 | 1297 | 622 | 365 | 0.56 |
| | B7 | 1.20 | 1252 | 486 | 363 | 0.52 |
| | B11 | 0.80 | 1277 | 576 | 380 | 0.47 |
| | B12 | 0.01 | 1302 | 588 | 397 | 0.44 |
| | AB1 | 0.30 | 1271 | 653 | 381 | 0.53 |
| | AB2 | 0.60 | 1264 | 627 | 355 | 0.46 |
| | AB3 | 0.90 | 1243 | 630 | 352 | 0.43 |
| Comparative Example | X1 | — | 1155 | 630 | 311 | 2.21 |
| | X2 | — | 1260 | 565 | 362 | 0.32 |
| | Y1 | 4.00 | 1221 | 640 | 301 | 1.41 |
| | Y2 | 0.005 | 1257 | 593 | 358 | 0.33 |
| Conventional Example | C2 | — | 1253 | 482 | 399 | 0.23 |

It is noted from Table 3, as a result of the proper addition of Zr and Hf, at least one of the hardness and compressive strength at ambient temperature was enhanced in Ni—Ir—Al—W alloys over the alloy of a conventional example having no addition (No. C2). Then, it can also be confirmed that the amount of displacement in a hot bending test also increased, and the toughness in a high temperature range was significantly improved. The addition of one of Zr and Hf is effective, and the addition of both is also effective.

Meanwhile, in the case where the amounts of Zr and Hf added are too small, the effects of these addition elements are weak, and the margin of improvement in toughness (the amount of bending displacement) is small (No. X2, No. Y2). In addition, when the amounts of Zr and Hf added are too large, the high-temperature strength significantly decreases, showing the minimum valve (No. X1, No. Y1). In particular, excessive addition of Zr also tends to decrease the dissolution temperature of the γ' phase, and may affect the stability of the γ' phase. Therefore, it was confirmed that the effects of Zr and Hf are exhibited only when their amounts added are controlled.

INDUSTRIAL APPLICABILITY

The present invention is a Ni-based heat-resistant alloy capable of stably exhibiting high-temperature strength. The present invention is suitable for members of gas turbines, airplane engines, chemical plants, automotive engines such as turbocharger rotors, high-temperature furnaces, and the like. In addition, as a particularly useful application, a tool for friction stir welding (FSW) is mentioned. The Ni-based heat-resistant alloy of the present invention has improved high-temperature strength and toughness, and is unlikely to break or snap during use as an FSW tool. In addition, the Ni-based heat-resistant alloy has improved ambient-temperature strength, and is also applicable to FSW of high-hardness ferrous materials and metal materials such as titanium alloys, nickel-based alloys, and zirconium-based alloys.

The invention claimed is:

1. A polycrystalline Ni-based heat-resistant alloy comprising Ir: 5.0 mass % or more and 50.0 mass % or less, Al: 1.0 mass % or more and 8.0 mass % or less, W: 5.0 mass % or more and 25.0 mass % or less, and balance Ni, having an L12-structured γ' phase present in the matrix, and including at least one of Zr: 0.8 mass % or more and 2.0 mass % or less and Hf: 1.0 mass % or more and 2.0 mass % or less.

2. The polycrystalline Ni-based heat-resistant alloy according to claim 1, further comprising C: 0.001 mass % or more and 0.5 mass % or less.

3. The polycrystalline Ni-based heat-resistant alloy according to claim 1, comprising 1.2 mass % or more and 2.0 mass % or less of Zr.

4. The polycrystalline Ni-based heat-resistant alloy according to claim 1, comprising 1.2 mass % or more and 2.0 mass % or less of Hf.

5. The polycrystalline Ni-based heat-resistant alloy according to claim 1, comprising 1.0 mass % or more and 2.0 mass % or less of Zr and 1.0 mass % or more and 2.0 mass % or less of Hf.

6. The polycrystalline Ni-based heat-resistant alloy according to claim 1, comprising at least one addition element selected from the following:

B: 0.001 mass % or more and 0.1 mass % or less
Co: 5.0 mass % or more and 20.0 mass % or less
Cr: 1.0 mass % or more and 25.0 mass % or less
Ta: 1.0 mass % or more and 10.0 mass % or less
Nb: 1.0 mass % or more and 5.0 mass % or less
Ti: 1.0 mass % or more and 5.0 mass % or less
V: 1.0 mass % or more and 5.0 mass % or less
Mo: 1.0 mass % or more and 5.0 mass % or less.

7. The polycrystalline Ni-based heat-resistant alloy according to claim 6, comprising 1.0 mass % or more and 2.0 mass % or less of Zr and 1.0 mass % or more and 2.0 mass % or less of Hf.

8. The polycrystalline Ni-based heat-resistant alloy according to claim 6, further comprising C: 0.001 mass % or more and 0.5 mass % or less.

9. The polycrystalline Ni-based heat-resistant alloy according to claim 8, comprising 1.2 mass % or more and 2.0 mass % or less of Zr.

10. The polycrystalline Ni-based heat-resistant alloy according to claim 8, comprising 1.0 mass % or more and 2.0 mass % or less of Zr and 1.0 mass % or more and 2.0 mass % or less of Hf.

* * * * *